US005550882A

United States Patent [19]

Lehnert et al.

[11] Patent Number: 5,550,882

[45] Date of Patent: Aug. 27, 1996

[54] CONTAINERS FOR TRANSPORTATION AND STORAGE OF SPENT NUCLEAR FUEL

[75] Inventors: Robert A. Lehnert, Milpitas; Robert D. Quinn, Morgan Hill; Steven E. Sisley, Fremont; Brandon D. Thomas, San Jose, all of Calif.

[73] Assignee: Vectra Technologies, Inc., Federal Way, Wash.

[21] Appl. No.: 488,727

[22] Filed: Jun. 8, 1995

Related U.S. Application Data

[62] Division of Ser. No. 131,971, Oct. 8, 1993, Pat. No. 5,438, 597.

[51] Int. Cl.[6] ..... G21F 5/008

[52] U.S. Cl. ..... 376/272; 376/313

[58] Field of Search ..... 376/272, 313; 250/506.1, 507.1

[56] References Cited

U.S. PATENT DOCUMENTS

| | | | |
|---|---|---|---|
| 3,111,586 | 11/1963 | Rogers | 376/272 |
| 3,483,381 | 12/1969 | Bonilla et al. | 376/272 |
| 3,600,792 | 8/1971 | Valluy et al. . | |
| 3,731,101 | 5/1973 | Peterson et al. . | |
| 3,886,368 | 5/1975 | Rollins et al. . | |
| 3,962,587 | 6/1976 | Dufrane et al. . | |
| 4,006,362 | 2/1977 | Mollon et al. . | |
| 4,096,392 | 6/1978 | Rubinstein et al. . | |
| 4,319,960 | 3/1982 | Larson et al. . | |
| 4,446,098 | 5/1984 | Pomaibo et al. . | |
| 4,532,104 | 7/1985 | Wearden et al. . | |
| 4,543,488 | 9/1985 | Diem . | |
| 4,666,659 | 5/1987 | Lusk et al. . | |
| 4,721,597 | 1/1988 | Wachter . | |
| 4,746,487 | 5/1988 | Wachter . | |
| 4,760,637 | 8/1988 | Kerrey et al. . | |
| 4,780,269 | 10/1988 | Fischer et al. . | |
| 4,781,883 | 11/1988 | Daugherty et al. . | |
| 4,800,283 | 1/1989 | Efferding . | |
| 4,803,042 | 2/1989 | Gilmore et al. . | |
| 4,825,088 | 4/1989 | Nair et al. . | |
| 4,827,139 | 5/1989 | Wells et al. . | |
| 4,930,650 | 6/1990 | Wells . | |
| 5,102,615 | 4/1992 | Grande et al. . | |
| 5,347,555 | 9/1994 | Knecht et al. | 376/313 |

FOREIGN PATENT DOCUMENTS

| | | | |
|---|---|---|---|
| 61-57894 | 3/1986 | Japan | 376/272 |
| 62-8000 | 2/1987 | Japan | 376/272 |

OTHER PUBLICATIONS

Report of United States Atomic Energy Commission Safety Evaluation by the Transportation Branch, Directorate of Licensing, General Electric Company, Model IF–300, Shipping Cask; (19 pp.) with drawing of cask; Sep. 24, 1973.

*Primary Examiner*—Daniel D. Wasil

*Attorney, Agent, or Firm*—Christensen O'Connor Johnson & Kindness PLLC

[57] ABSTRACT

Disclosed is a transportation and storage assembly for transporting and storing nuclear fuel rod assemblies. The transportation and storage assembly includes a basket assembly (24) designed for failed nuclear fuel rod assemblies, or a basket assembly (122) designed for undamaged nuclear fuel rod assemblies. The basket assemblies (24, 122) are inserted into a canister (22). The canister (22) includes a shell (26) that receives and surrounds the basket assemblies (24, 122), and lids (28, 96) that enclose the shell (26). The basket assemblies (24, 122) include a plurality of apertured plates (36, 124) interconnected by structural members (42, 88) that maintain the plates (36, 124) in a spaced apart relationship, axially aligning the apertures (38, 126) in the plates (36, 124). In the basket assembly (24) for failed nuclear fuel rod assemblies, a container (44) is inserted into a row of axially aligned apertures (122), having a drain passage (104). In the basket assembly (122) for undamaged nuclear fuel rod assemblies, a plurality of guide sleeve assemblies (132) are formed from structural members (134, 138), and a layer (136) including a neutron poisoning material. The containers (44) and guide sleeve assemblies (132) are each for receiving a nuclear fuel rod assembly.

16 Claims, 10 Drawing Sheets

CONTAINERS FOR TRANSPORTATION AND STORAGE OF SPENT NUCLEAR FUEL

This is a divisional of the prior U.S. patent application Ser. No. 08/131,971, filed on Oct. 8, 1993, of Robert A. Lehnert, Robert D. Quinn, Steven Sisley, and Brandon D. Thomas for CONTAINERS FOR TRANSPORTATION AND STORAGE OF SPENT NUCLEAR FUEL, issued as U.S. Pat. No. 5,438,597 on Aug. 1, 1995, the benefit of the filing date of which is hereby claimed under 35 U.S.C. §120.

FIELD OF THE INVENTION

The present invention generally relates to containers for storage and transportation of spent nuclear fad, and in particular, to containers for transportation of spent nuclear fuel across areas accessible to the public.

BACKGROUND OF THE INVENTION

In a nuclear reactor, the fissionable material gradually becomes spent and must be removed. Since the spent fuel contains fission by products which are highly radioactive, and which generate large amounts of heat, the spent fuel is usually temporarily stored in the reactor's spent fuel pool. The spent fuel pool is a pool of water of sufficient volume to prevent the escape of harmful radiation, and to absorb and dissipate the heat generated by the decaying fissionable material. Alternatively, the spent fuel may be temporarily stored in a hot cell. That is, a heavily shielded structure having the capability to prevent the escape of harmful radiation, while absorbing and dissipating the heat generated by the spent fuel.

Generally, there is limited storage space in a nuclear reactor's spent fuel pool, or in its hot cell. Thus, the spent fuel must be moved to a storage site to make room for additional spent fuel. In some cases, there is a desire to shut the nuclear reactor down, and remove all fissionable material, in which case, all of the fissionable material must be removed to a storage site.

There are two primary problems in the transportation of spent fuel. The most difficult problem is the transportation of spent fuel that includes failed fuel rod assemblies. Typically, nuclear fuel is formed of numerous small pellets that are inserted into a hollow rod. In some cases the rods become damaged and allow some of the nuclear fuel pellets to escape. These damaged rods are known as failed fuel rods. Further, in some cases during nuclear reaction of the fuel, the pellets disintegrate into sand-sized particles, capable of easily escaping from a failed fuel rod. The fuel rods themselves are arranged into assemblies including several fuel rods. Thus, a fuel rod assembly including a failed fuel rod is termed a failed fuel rod assembly.

An important part of transporting and storing spent fuel is avoiding criticality. This is achieved by carefully arranging the spent fuel rod assemblies so that there is a minimum distance between each assembly, such that there is little chance of neutron multiplication occurring to the point of criticality. In the case of failed fuel rod assemblies, however, fissionable material can escape from failed rods, and potentially accumulate near enough to other fissionable material that criticality is achieved.

One attempted solution to the foregoing problem has been simply to store failed fuel rod assemblies indefinitely in a nuclear reactor's spent fuel pool or hot-cell. The problem with storing failed fuel rod assemblies indefinitely, however, is that there is limited storage space in a nuclear reactor's spent fuel pool or in its hot-cell, and in some cases there is a desire to completely shut a nuclear reactor down, and remove all fissionable material, including that contained in failed fuel rod assemblies.

Another attempted solution has been to transport failed fuel rod assemblies in fuel transportation containers designed for undamaged fuel rod assemblies. The foregoing attempted solution, however, has required that substantially fewer failed fuel rod assemblies be transported per container, compared to the number of undamaged fuel rod assemblies that can be transported in the same container. By transporting fewer failed fuel rod assemblies, even if some fissionable material escapes from the failed fuel rods, and accumulates near other fissionable material in the container, there is not enough fissionable material in the entire container to pose a significant risk of criticality. The problem with the foregoing solution, though, is it wasteful of resources, because significantly fewer failed fuel rod assemblies can be transported per container, relative to the number of undamaged fuel rod assemblies that can be transported in the same container.

Another, attempted solution has been to transport failed fuel rod assemblies in fuel transportation containers designed for transporting fissionable material in the form of rubble. That is, the fissionable material is not in the form of rods, but is in the form of small particles. Thus, the failed fuel rods are broken up into rubble, and placed in the container. The problem with that solution, however, is that the method is inefficient for three principle reasons. First, the failed fuel rod assemblies be broken up. Second, such containers are capable only of transporting comparatively few failed fuel rod assemblies. Finally, the transportation container is only designed for transportation, not storage. Thus, once the fissionable material has been transported to another location, the container must be unloaded in a fuel pool or in a hot cell, and other arrangements made to store the fissionable material.

The present invention solves the foregoing problems, and provides a device for transporting and storing failed fuel rod assemblies at a storage site, other than in a spent fuel pool or hot cell.

The other major problem with transporting spent nuclear fuel is that United States law imposes stringent safety requirements even on containers used to transport undamaged fuel rod assemblies. The relevant law imposes significantly more restrictive requirements with respect to the transportation of spent nuclear fuel across areas accessible to the public, as opposed to areas inaccessible to the public.

State of the art spent fuel transportation containers for areas accessible to the public are casks with individual compartments. The fuel rod assemblies are loaded into individual compartments in the casks in a spent fuel pool or a hot cell. The purpose of the individual compartments within each cask is to ensure sufficient spacing between adjacent fuel rod assemblies to avoid any danger of criticality. The fuel rod assemblies are loaded into the cask in a spent fuel pool or hot cell. Upon reaching the storage location, the fuel rod assemblies must be removed from the cask in a spent fuel pool or hot cell, and then stored.

In contrast, state of the art spent fuel transportation containers for areas inaccessible to the public are typically a sealed canister placed within a cask. The fuel rod assemblies are loaded into individual compartments in a canister in a spent fuel pool or a hot cell. The canister is then sealed and placed in a cask. When the cask/canister assembly reaches the storage site, the canister is removed from the cask, stored, and the cask may be reused, which is a much more efficient process.

Nonetheless, the cask/canister method cannot be used for transportation in areas accessible to the public because they fail to meet the requirements imposed by U.S. law. Accordingly, there is a need for an invention that provides for the transportation and storage of failed fuel rod assemblies, and for a cask/canister device for transportation and storage of spent fuel across areas accessible to the public. The present invention provides a solution, wherein a cask/canister device can be used, and additionally may be used with existing casks, resulting in much greater efficiency in the transportation over public thoroughfares and storage of spent nuclear fuel.

SUMMARY OF THE INVENTION

In one aspect, the present invention relates to a container for receiving a structurally damaged nuclear fuel assembly, the container being for the subsequent storage and transportation of the nuclear fuel assembly. The nuclear fuel assembly includes fissionable material, and is received by the container from within a fuel pool. The container includes an elongated receptacle that forms an enclosure. The receptacle includes an open end for receiving the structurally damaged nuclear fuel assembly. A cover is provided to mate with, and close the open end of the receptacle. Further, a drainage passage is defined in the container, so that liquid can be drained from the interior of the receptacle to the exterior of the receptacle. Additionally, the drainage passage includes a restrictor that prevents the passage of fissionable material through the drainage passage. The container may also include an exterior projection for receiving fuel handling tools used to handle the container.

In another aspect, the present invention relates to a canister for receiving structurally damaged nuclear fuel assemblies, and for the subsequent storage and transportation of the nuclear fuel assemblies. The nuclear fuel assemblies include fissionable material, and are received by the canister from within a fuel pool. The canister includes a basket assembly having a plurality of apertured plates, and structural members interconnecting the apertured plates.

The structural members maintain the plates in a spaced apart relationship, axially aligning the apertures in each plate into a plurality of rows. The basket assembly is received in an exterior shell that forms an enclosure open at one end. The basket assembly is surrounded by the shell, and is oriented such that the longitudinal axis of each row is substantially parallel to the longitudinal axis of the shell.

A container is inserted into each row of axially aligned apertures. Each container is for containing a damaged nuclear fuel assembly, and includes an elongated receptacle that forms an enclosure, having an open end. The structurally damaged nuclear fuel assemblies are inserted through the open end of the enclosure into the receptacle.

A cover is provided to mate with the open end of the receptacle, and substantially close the open end of the receptacle. Moreover, a drainage passage is defined in each container, for draining liquid out of the container. The drainage passage includes a restrictor that prevents the passage of fissionable material. A lid is also provided to mate with the open end of the shell, thereby closing the open end of the shell. Further, the exterior of each container may also include a projection for receiving fuel handling tools to remove and insert the containers into the canister.

In a further aspect, the present invention includes a canister for storing and transporting nuclear fuel assemblies which includes a basket assembly. The basket assembly again includes a plurality of apertured plates, and structural members interconnecting the apertured plates. The structural members maintain the plates in a spaced apart relationship with the apertures in each plate axially aligned into a plurality of rows.

An exterior shell, forming an enclosure open at one end, receives and surrounds the basket assembly. The basket assembly is oriented within the shell such that the longitudinal axis of each row is substantially parallel to the longitudinal axis of the shell. A plurality of guide sleeves are provided with the basket assembly, the number of guide sleeves corresponding to the number of rows of axially aligned plate apertures.

Each guide sleeve has a longitudinal axis that is generally coincident with a corresponding row, and includes a first structural layer, a neutron absorbing layer, supported by the first structural layer; and a second structural layer, structurally supporting the side of the neutron poisoning layer opposite the first structural layer. A lid is included to mate with the open end of the shell, thereby closing the open end of the shell. Preferably, the first structural layer comprises a hollow steel jacket inserted into each row of axially aligned apertures. Other features of the present invention will become apparent from the following detailed description.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Transportation and Storage of Failed Fuel Rod Assemblies

Figure 1:
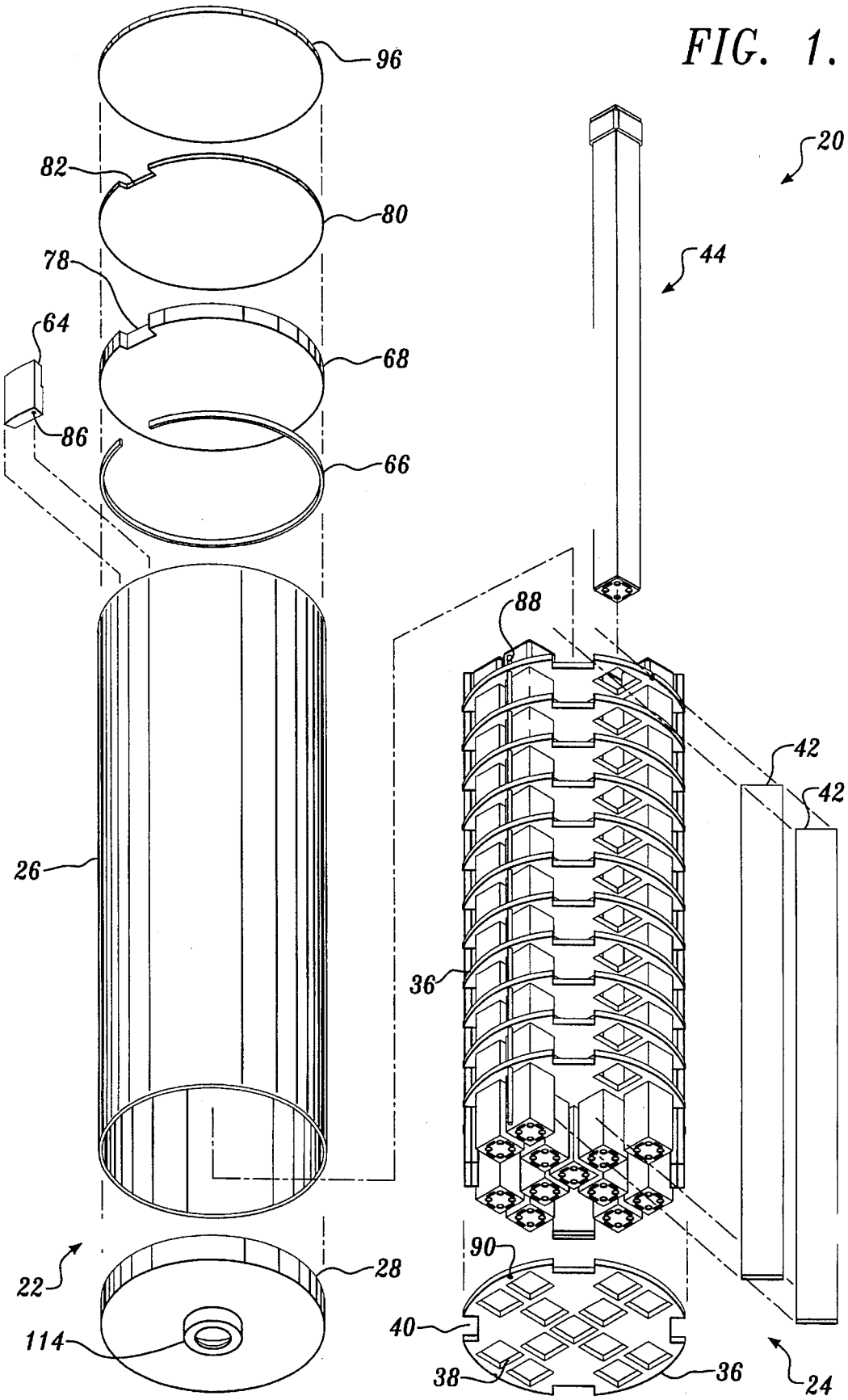
FIG. 1 is a partially exploded isometric view of one aspect of a container for transporting and storing spent nuclear fuel in accordance with the present invention.

FIG. 1 shows a transportation and storage assembly indicated generally by reference numeral 20 formed in accordance with the present invention. Transportation and storage assembly 20 is preferably for the storage and transport of failed fuel rod assemblies for a nuclear reactor. However, it will be readily appreciated by those skilled in the art that assembly 20 could also be used for the transportation and storage of undamaged nuclear fuel rod assemblies.

For convenient reference, transportation and storage assembly 20 has been divided into two major components, the canister indicated generally by reference numeral 22 and the basket assembly indicated generally by reference numeral 24. Canister 22 includes a substantially cylindrical hollow shell 26. A bottom lid 28 caps the bottom of shell 26, forming a base. Bottom lid 28 has a substantially circular cross section of a diameter approximately equal to the inside diameter of shell 26. Bottom lid 28 is inserted into the bottom end of shell 26 until the generally planar bottom surface of lid 28 is flush with the bottom edge of shell 26. Bottom lid 28 is secured to shell 26 by conventional means, such as welding to form an air-fight seal.

After bottom lid 28 has been welded into place, basket assembly 24 is inserted into the top open end of shell 26. Basket assembly 24 includes a plurality of generally circular plates 36 having a plurality of generally square-shaped apertures 38 formed therethrough. The plates 36 are preferably made of stainless steel. Plates 36 include four generally rectangular recesses 40 formed symmetrically around the outside edge of each plate 36, at approximately equal intervals. Rectangular recesses 40 are arranged so that the longer edge of each rectangular recess is generally perpendicular to a diagonal of each plate 36.

Figure 1A:
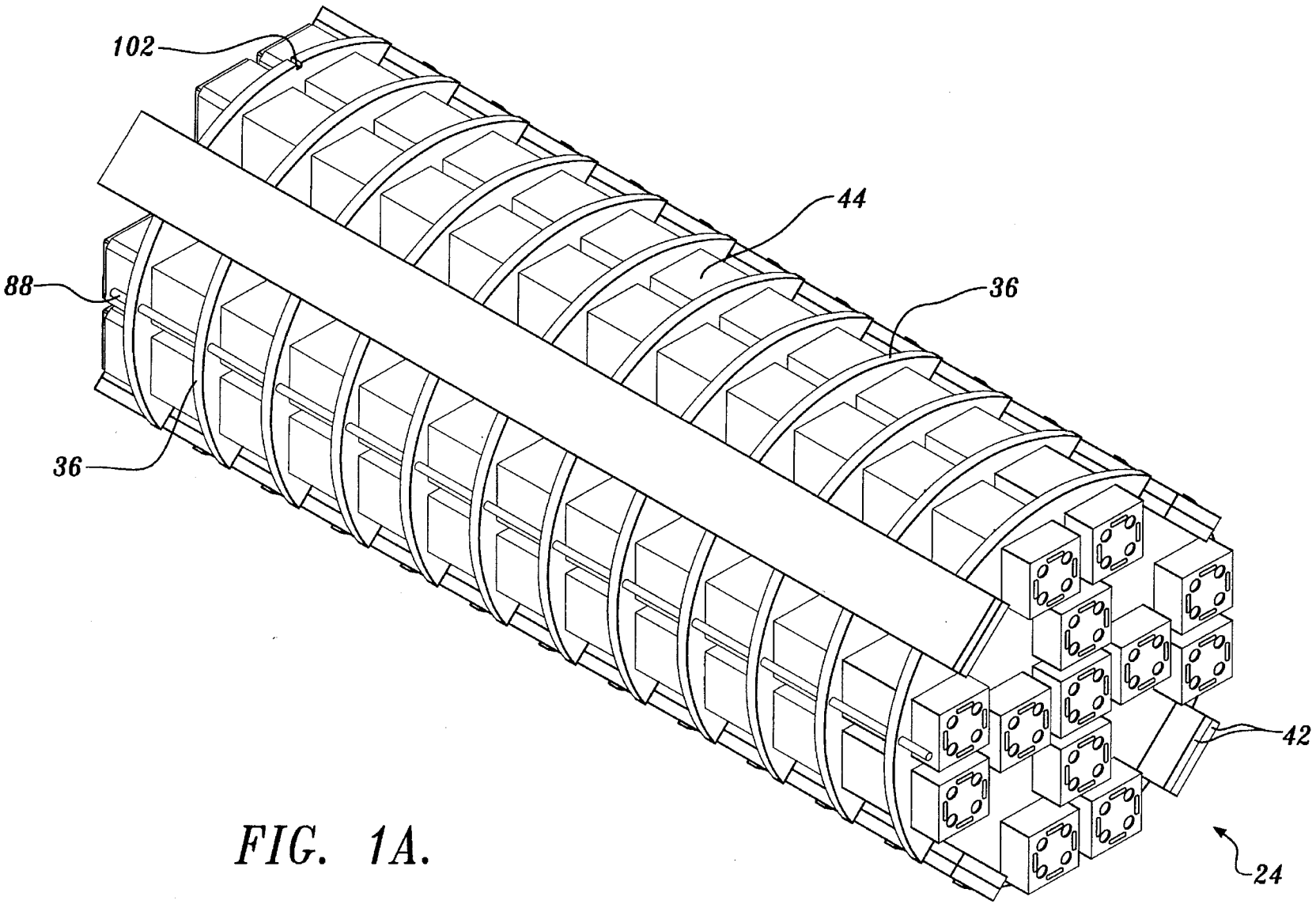
FIG. 1A is an isometric view of part of the container shown in FIG. 1, from another perspective.

Preferably, plates 36 are maintained in a spaced-apart axial alignment relative to one another by eight elongate rectangular plates 42. Rectangular plates 42 have a width that is substantially equal to the inside length of each rectangular recess in plates 36. Thus, rectangular recesses 40 receive rectangular plates 42. Hence, the series of plates 36 are attached to each rectangular plate 42 by conventional means such as welding to rigidly maintain plates 36 in a spaced-apart axially-aligned arrangement. In the illustrated embodiment, two plates 42 are stacked on top of one another so that each rectangular recess 40 receives two rectangular plates 42. Alternatively, each recess 40 could receive a single rectangular plate 42 of a greater thickness. Thus, in an alternative embodiment, four thicker rectangular plates 42 could be used, rather than eight plates. The ends of rectangular plates 42 project slightly beyond the surface of the first and last plates 36, as best seen in FIG. 1A.

Each plate 36 contains a substantially identical arrangement of square apertures 38. Thus, when the plates are axially aligned relative to one another by plates 42, apertures 38 are axially aligned into a plurality of rows. Inserted into each row is a failed fuel container, indicated generally by reference numeral 44 in FIG. 1.

Figure 2A:
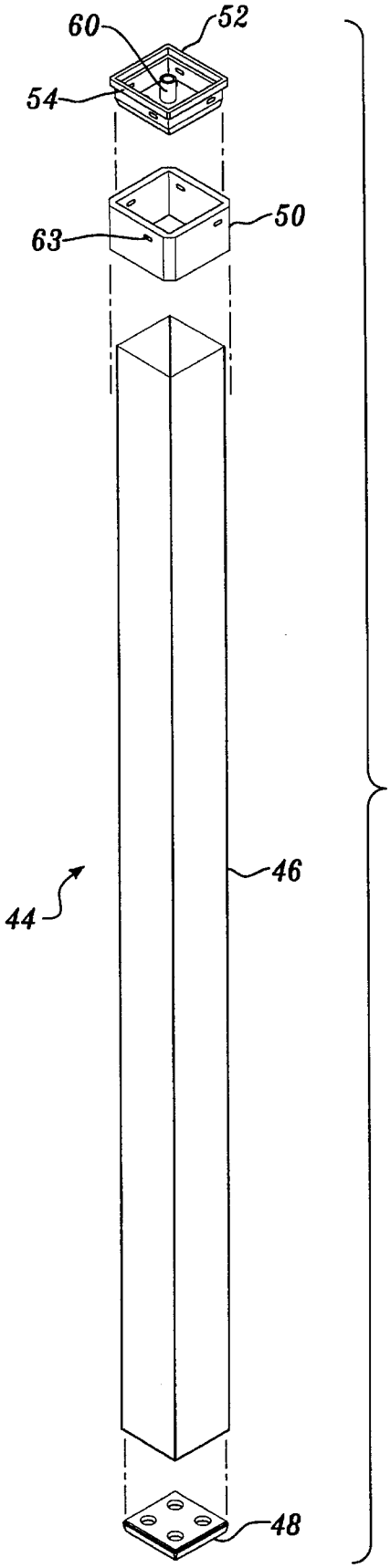
FIG. 2A is a partially exploded isometric view of part of the container shown in FIG. 1.

Turning to FIG. 2A, each failed fuel container 44 includes an elongate substantially square-shaped sleeve 46. Square-shaped sleeve 46 is capped at its bottom end by a square-shaped lid 48 that is welded to sleeve 46. Welded to the top end of the sleeve 46 is a square-shaped sleeve 50 that is substantially shorter than sleeve 46. Square-shaped sleeve 50 has internal width dimensions substantially equal to the exterior width dimensions of sleeve 46. Thus, the top end of the longer sleeve 46 is inserted into the bottom end of shorter sleeve 50, whereupon the two sleeves are welded together. The open end of sleeve 50 receives top lid 52 which serves to cap failed fuel container 44.

Figure 2B:
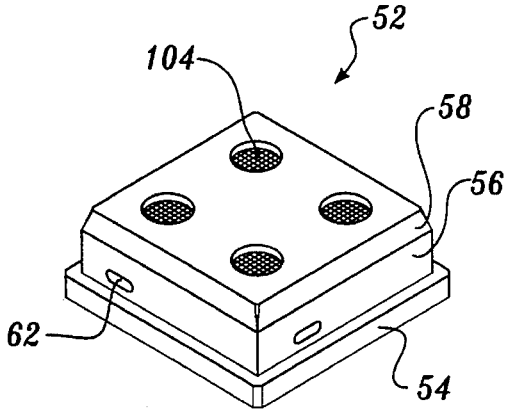
FIGS. 2B and 2C are isometric views of the lids of the container shown in FIG. 1.

Lid 52 is inserted into the shorter sleeve 50 until a lip 54, best seen in FIG. 2B, contacts the upper edge of sleeve 50. (FIG. 2B is a perspective view, looking towards the lower surface of lid 52.) Referring to FIG. 2B, lid 52 has an insertable portion 56 that is substantially square-shaped, and has a width dimension slightly smaller than the internal width dimension of the shorter square-shaped sleeve 50. Thus, the insertable portion 56 of the lid 52 slidably fits within shorter sleeve 50. Lid 52 includes a beveled portion 53 to facilitate sliding lid 52 into place in the shorter sleeve 50.

Returning to FIG. 2A, lid 52 includes a centrally mounted pintle 60, projecting radially from the upper surface of lid 52. Pintle 60 is substantially identical to a conventional control rod cluster pintle so that standard fuel handling tools available at a nuclear reactor can be used to remove and insert lid 52 into shorter sleeve 50.

Additionally, lid 52 includes four oval slots 62 formed symmetrically in each vertical wall that define insertable portion 56 of lid 52, best seen in FIG. 2B. When lid 52 is inserted into shorter sleeve 50, oval slots 62 line up with corresponding oval slots 63 formed in each vertical wall of shorter sleeve 50. Hence, the prongs on handling tools can be used to engage slots 62 and 63 when the lid 52 is in place, so that the entire failed fuel 44 container can be manipulated with the tools. Further, slots 62 and 63 may be optionally fitted with a pin (not shown) to lock lid 52 into place on shorter sleeve 50.

As is well known by those skilled in the art, fuel rods used by nuclear reactors in the United States comprise a plurality of rods maintained in radially spaced-apart relationship by a plurality of generally square-shaped brackets, having an interior grid that supports each individual fuel rod in the assembly. The internal width dimensions of the square-shaped sleeve 46 are sized preferably so that there is a sliding fit between the square-shaped brackets holding the fuel rods together in the assembly and the internal walls of the square-shaped sleeve 46. The sliding fit is such that there is a small gap between the square-shaped bracket holding the fuel rods together and the internal walls of sleeve 46. Preferably, sleeve 46 is made of stainless steel, but may be made of any material of sufficient structural rigidity that has the capability to significantly impede the passage of neutrons therethrough. Other substances that may be used include cadmium, borated stainless steel, borated ceramic materials, and a layer of borated aluminum sandwiched between structural members, as described later in the discussion of Transportation and Storage for Undamaged Fuel Rod Assemblies.

Returning to FIGS. 1 and 1A, a failed fuel container 44 is inserted longitudinally into each row of axially aligned apertures 38. The internal width dimensions of square-shaped apertures 38 is substantially equal to the external width dimensions of square-shaped sleeve 46, such that there is a sliding fit. Failed fuel containers 44 are each inserted into rows of axially aligned apertures 38, until the bottom surface of shorter sleeve 50 contacts the upper surface of upper plate 36. Thus, shorter sleeve 50 serves to limit the depth to which a failed fuel container 44 may be inserted into an axially aligned row of apertures 38.

When basket assembly 24 is inserted in shell 26, basket assembly 24 rests on the bottom ends of rectangular plates 42 that project beyond the surface of the last plate 36, as best seen in FIG. 1A. Once inserted in shell 26, basket assembly 24 is sealed in place by a series of items welded to the top end shell 26. The first item welded into place is a siphon tube mounting block 64. Siphon tube mounting block 64 is welded to the inside of shell 26, adjacent to the upper surface of the top plate 36.

Figure 6A:
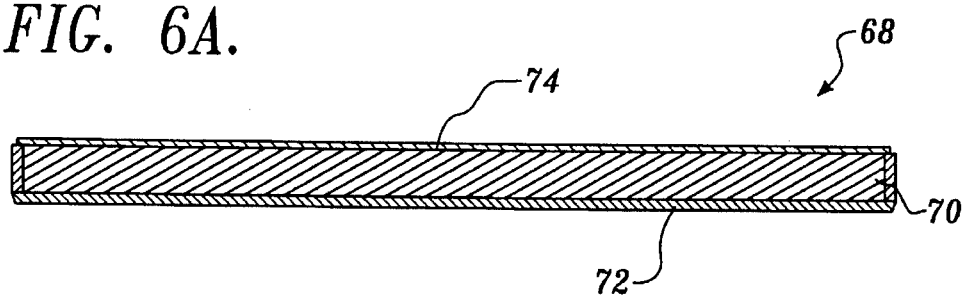

Welded around the inner periphery of shell 26, at an elevation intermediate the upper and lower surfaces of siphon tube mounting block 64 is a ring 66. Ring 66 includes a cut-out portion for the siphon tube mounting block. The next item is a shield plug 68 which is for preventing the escape of harmful radiation to the environment. Preferably, shield plug 68 includes a layer of lead 70, surrounded on its lower and radial sides by a steel layer 72. Lead layer 70 is sealed on its upper surface by a thinner layer of steel 74, as shown in FIG. 6A.

Shield plug 68 is preferably not welded to shell 26 for the following reasons. When shield plug 68 is in place, it is shielding against the escape of harmful radiation from the interior of shell 26. Thus, exposure of personnel to any radiation must be kept at a minimum, requiring that shell 26 be sealed in a minimum of time. Therefore, shield plug 68 is dropped into place, and an inner top cover plate 80 is welded into place over shield plug 68. As inner top cover plate 80 is preferably made only of stainless steel, a simple weld is required because there is no danger of melting lead and causing contamination of the weld. In contrast, welding of shield plug 68 would pose such a danger. The peripheral edge of inner top cover plate 80 includes an essentially rectangular recess 82, that receives the siphon tube mounting block 64, illustrated in FIG. 1.

In regard to the type of material comprising storage and transportation assembly 20, preferably the shell 26 is made of stainless steel. Other types of materials e.g. carbon steel, may be used, but stainless steel is preferred for its structural strength, ability to withstand corrosion, ability to significantly impede the passage of neutrons, and ability to withstand welding without a loss of ductility, requiring subsequent heat treatment. In addition, preferably all components that are welded together comprise the same type of material, to avoid complications from different materials that have different material properties, such as different rates of thermal expansion. Therefore, any items welded to the shell 26, such as the siphon tube mounting block 64, the ring 66, the inner top cover plate 80, etc., are also preferably made of stainless steel. In contrast, circular plates 36 and interconnecting rectangular plates 42 are preferably made of a high strength carbon steel, to provide a high strength supporting framework.

Since shield plug 68 is not welded to shell 26, steel layers 72 and 74 comprising shield plug 68 may be made of a different material that is less expensive than stainless steel, such as carbon steel. Alternatively, shield plug could be made of solid steel as shown in shield plug 76 in FIG. 5A. Notwithstanding, solid steel shield plug 76 is thicker, relative to shield plug 68 with an interior lead layer 70, because lead has greater shielding capabilities than steel.

Referring to FIG. 1, the peripheral edge of shield plug 68 includes an essentially rectangular recess 78 so that shield plug 68 slides over the top of siphon tube mounting block 64. In the foregoing position, shield plug 68 is supported by ring 66, and the step 79, shown in FIG. 10A, in siphon tube mounting block 64. When shield plug 68 is in place on ring 66 and step 79, the clearance between the lower surface of shield plug 68 and each failed fuel container 44 is sufficiently small to prevent the displacement of top lid 52 from each failed fuel container.

Typically, fuel rod assemblies are loaded into storage assembly 20 in the fuel pool of a nuclear reactor. Thus, the fuel rod assemblies are loaded into storage assembly 20 under water. The underwater loading makes it necessary to remove the water from canister 22 after the transportation and storage assembly 20 has been removed from the fuel pool. For this purpose, a siphon tube arrangement has been provided in accordance with the present invention. The siphon tube arrangement includes siphon tube mounting block 64 attached to the upper portion of shell 26, adjacent the inner top cover plate 80. Defined longitudinally through the siphon tube mounting block 64 are two passages 84 and 86, shown in FIGS. 10A and 10B. Passages 84 and 86 include right angles, so that there is not a straight through passage which prevents radiation streaming and minimizes the escape of harmful radiation. Additionally, passage 86 includes a T-shaped portion, with one branch of the "T" plugged. The T-shaped portion is included simply for ease of manufacturing purposes because passages 86 and 84 are preferably formed by boring or drilling.

Once inner top cover plate 80 has been welded into place, an air-tight interior cavity is formed inside of shell 26, with the only access being through passages 84 and 86 in siphon tube mounting block 64. The siphon tube arrangement includes a siphon tube 88 connected to passage 86 in siphon tube mounting block 64. As can be seen in FIG. 1, siphon tube 88 passes through a generally circular aperture 90 defined in each plate 36. An enlarged view of basket assembly 24 is provided by in FIG. 1A, which also includes an enlarged view of siphon tube 88.

Figure 6B:
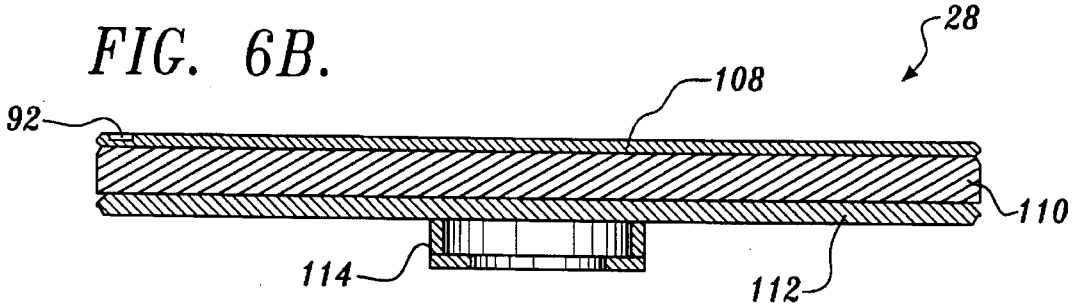

The foregoing siphon arrangement is used to remove liquid from canister 22 in the following manner. An air hose (not shown) is connected to passage 84 in siphon tube mounting block 64. Preferably, passage 84 has been threaded and fitted with a "quick-connect and disconnect" fitting, such that an air hose can be rapidly connected and disconnected from the passage. Compressed air, or another gas, is then forced into shell 26, which in turn forces any fluid in the canister to exit through siphon tube 88. To ensure that substantially all liquid is forced out of shell 26, counter bore 92 is formed in the upper surface of bottom lid 28, as shown in FIG. 6B. The bottom end of siphon tube 88 extends below the upper surface of bottom lid 28 into counter bore 92, ensuring that substantially all fluid within shell 22 can be-forced out through the siphon tube.

Figure 10A:
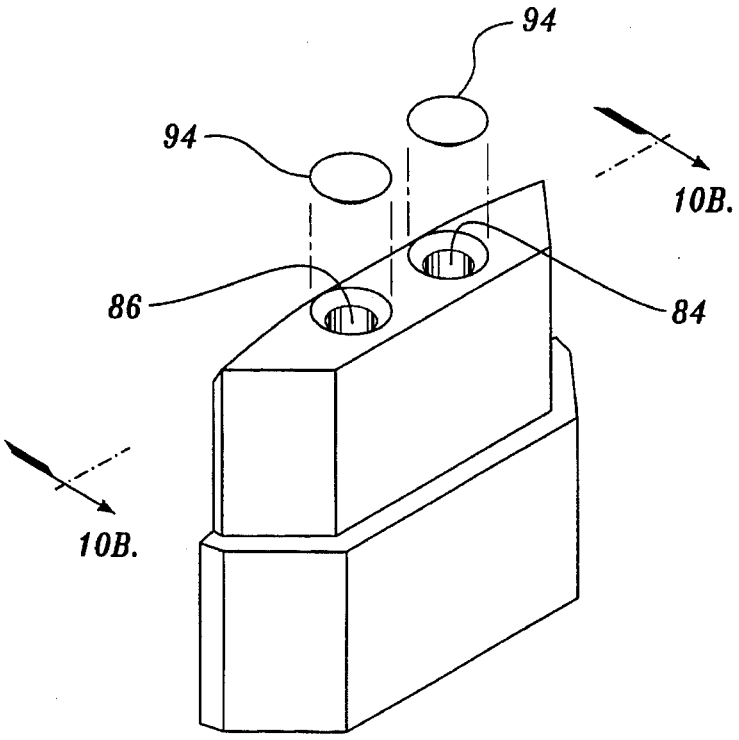
FIG. 10A is an isometric view of a siphon tube mounting block formed in accordance with the present invention.
Figure 10B:
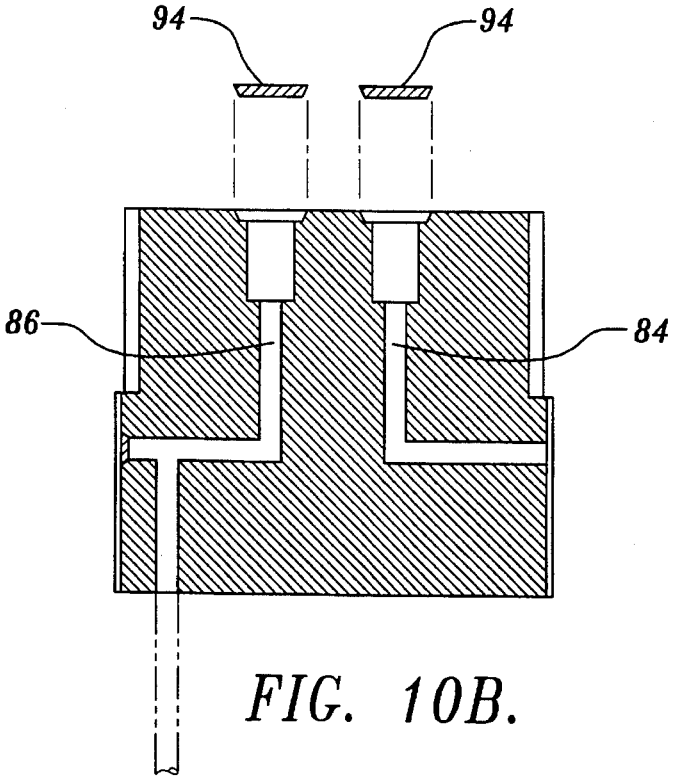
FIG. 10B is a cross-sectional view of the siphon tube mounting block in FIG. 1, along line 10A—10A in FIG. 10A.

Once substantially all liquid has been forced out of shell 22, compressed air, or other gas can be continually forced through passage 84, and out of siphon tube 88 until any remaining liquid has been evaporated. Then, end caps 94, shown in FIG. 10A, are welded over each of passages 84 and 86, forming a completely airtight seal in the interior of shell 26. Shell 26 is then further sealed by welding a substantially circular outer top cover plate 96 around the inner periphery of shell 26 as shown in FIG. 1. As shown in FIG. 1, outer top cover plate 96 is welded over the upper surface of siphon tube mounting block 64 and inner top cover plate 80.

Figure 9A:
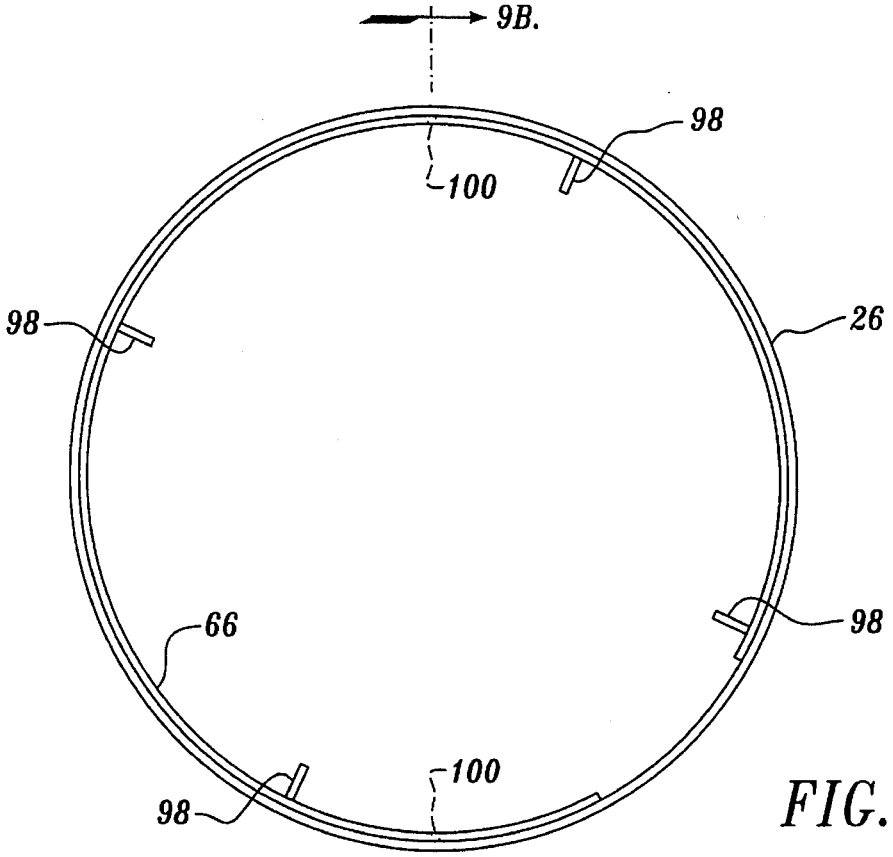
FIG. 9A is a plan view of part of a shell shown in FIG. 1.
Figure 9B:
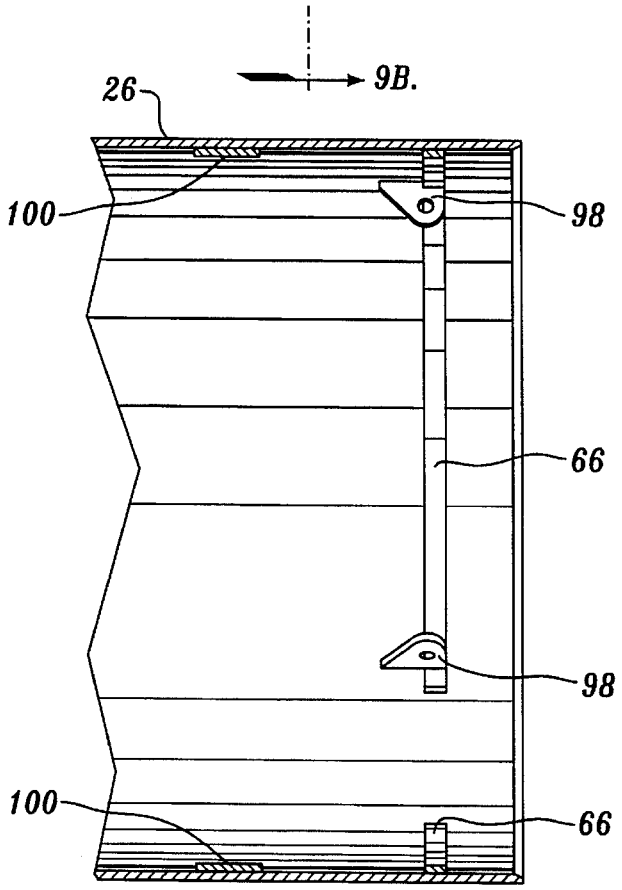
FIG. 9B is a cross-sectional view of the shell in FIG. 1, along line 9B—9B in FIG. 9A.

As may be readily appreciated by those skilled in the art, canister 22 includes significant amounts of steel and is heavy Therefore, canister 22 may include lifting lugs 98 to facilitate maneuvering the canister with equipment, as shown in FIGS. 9A and 9B. Preferably, four lifting lugs 98 are attached symmetrically, at substantially equal intervals and elevations around the inner periphery of shell 26. In FIGS. 9A and 9B, the lifting lugs 98 are welded to the inner radial surface of ring 66. Usually, a fuel transportation and storage assembly 20 is placed inside a cask (not shown), when the assembly is used for transportation. Thus, the lifting lugs 98 facilitate the insertion of canister 22 into a cask.

The cask provides additional support and protection of the environment from harmful radiation, and the cask includes lifting trunions that facilitate maneuvering the cask with equipment. One such cask is described in an application entitled Transportation and Storage Cask for Spent Nuclear Fuel, filed on Oct. 8, 1993, and assigned U.S. patent application Ser. No. 08/131,973, now U.S. Pat. No. 5,406,600 by Kyle B. Jones, Robert A. Lehnert, Ian D. McInnes, Robert D. Quinn, Steven E. Sisley, and Charles J. Temus. The subject matter of the above-identified application is expressly incorporated herein by reference.

When the cask/canister combination is transported on a vehicle, it is typically placed in an impact limiter for further safety. The impact limiter attenuates shocks that might occur during transportation, for example during a vehicle accident, and thus protects the cask/canister combination from damage, and the environment from the escape of harmful radiation. One such impact limiter is described in an application entitled Impact Limiter for Spent Nuclear Fuel Transportation Cask, filed on Oct. 8, 1993 and assigned U.S. patent application Ser. No. 08/131,972, now U.S. Pat. No. 5,394,449 by Robert A. Johnson, Ian D. McInnes, Robert D. Quinn, and Charles J. Temus. The subject matter of the above-identified application is expressly incorporated herein by reference.

Bottom cover plate 28 is a sandwiched layer construction as shown in FIG. 6B. The top most layer 108 is steel, while the middle layer 110 is lead, followed by a bottom layer 112 of steel. Generally, top steel layer 108 is welded to the inner surface of shell 26 first. Subsequently, lead is poured over bottom steel layer 112, to form lead layer 110. Layers 110 and 112 are then inserted and layer 112 is welded to shell 26. Welding may be performed with lead incorporated into the bottom lid 28 because at the time the bottom lid is inserted, the shell does not contain fuel rod assemblies. Thus, with no danger of exposure to harmful radiation, more time consuming welding operations can be conducted which reduces the danger of lead contamination of the welds, in contrast to shield plug 68.

Figure 5A:
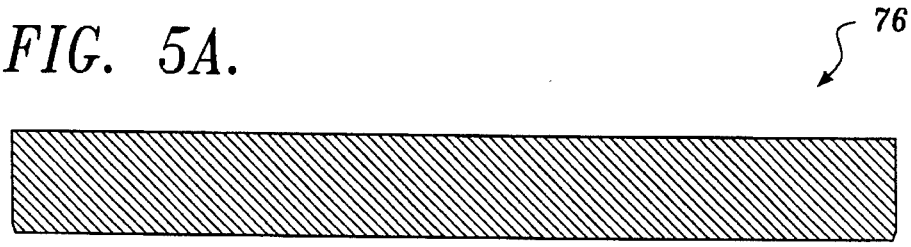
FIGS. 5A, 5B, 6A, and 6B are cross-sectional views of shield plugs formed in accordance with the present invention.
Figure 5B:
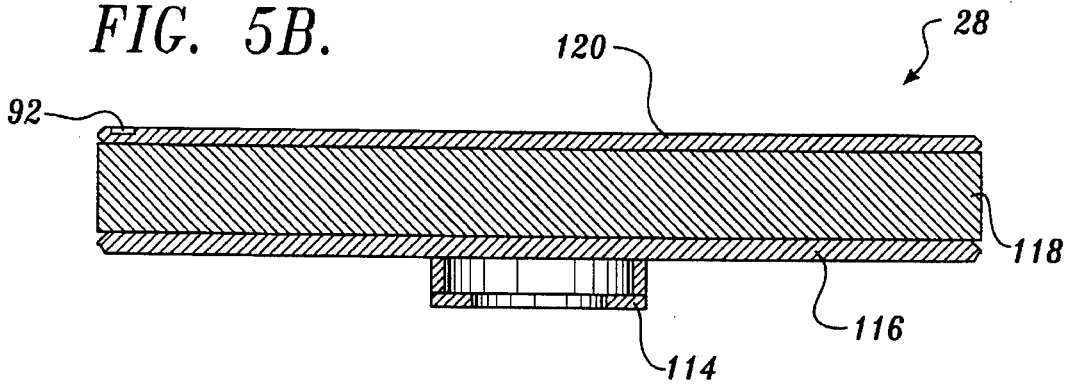

Alternatively, bottom lid 28 may be composed of all steel layers as shown in FIG. 5B. However, steel does not have the shielding ability of lead, and thus bottom lid 28 of FIG. 5B is thicker relative to bottom lid 28 of FIG. 6A. In FIG. 5B first layer 116 is preferably a stainless steel layer for welding to the inner surface of shell 26. The next layer 118 is less expensive carbon steel, to provide shielding, which is a dissimilar material from shell 26, and therefore is not welded to shell 26. The top-most layer is another stainless steel layer 120, that is welded to shell 26.

Finally, bottom lid 28 includes a ram engagement ring 114 in FIGS. 1, 5B, and 6B. Ram engagement ring 114 mates with a hydraulic ram (not shown) for pushing and pulling the canister 22 along its longitudinal axis, for example, to insert into or remove it from a storage site.

When basket assembly 24 is inserted into canister 22, rotation of basket assembly 24 relative to canister 22 is prevented by two rectangular keys 100 that project radially from the inner radial surface of shell 26, and ring 66, shown in FIGS. 9A and 9B. Preferably keys 100 are welded to the inner radial surface of the shell 26 at approximately equal elevations and spaced apart 180° around the inner periphery of shell 26. The radially projecting keys 100 are received by two rectangular slots 102 formed in the outer edge of the top-most plate 36 of the basket assembly 24, as illustrated in FIG. 1A. In FIG. 1A, only one slot 102 is visible, the other slot being spaced approximately 180° from slot 102. Preferably, basket assembly 24 is first inserted into shell 26, and then keys 100 are placed in slots 102 and welded to shell 26. Thus, keys 100 serve to prevent rotation of basket assembly 24 relative to canister 22, by bearing against slots 102 in top-most plate 36.

As previously noted, transportation and storage assembly 20 is preferably for use with failed fuel rod assemblies. As is well known in the art, a fuel rod includes a hollow tube, termed a cladding layer, that encloses a plurality of pellets comprising a fissionable material. The rods themselves, are arranged in assemblies of several rods, described previously. In some instances, the cladding layer becomes damaged, which is termed a failed fuel rod. Failed fuel rods may permit fissionable material to escape from the rod. Further, in some cases during nuclear reaction of the fuel, the pellets disintegrate into sand-sized particles, capable of easily escaping from a failed fuel rod.

As noted in the Background of the Invention, an important part of transporting spent fuel is avoiding criticality. This is achieved by carefully arranging the spent fuel rod assemblies so that there is a minimum distance between each assembly, such that there is little chance of neutron multiplication occurring to the point of criticality. In the case of failed fuel rod assemblies, however, fissionable material can escape from failed rods, and potentially accumulate near enough other fissionable material that criticality is achieved.

Figure 2C:
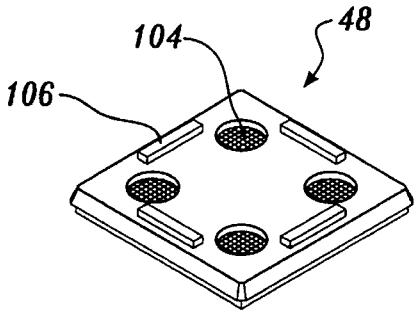

The storage and transportation assembly 20, however, addresses the foregoing problem by ensuring that substantially all fissionable material from a failed fuel rod assembly is kept confined to a single failed fuel container 44. For this purpose, top and bottom lids 52 and 48 each include four screened passages 104, best seen in FIGS. 2B and 2C. As shown in FIGS. 2B and 2C, the passages are positioned in the surfaces of the top and bottom lids 52 and 48, that are generally parallel to the top and bottom of the canister 22. (FIGS. 2B and 2C are perspective views, looking towards the lower surface of the top and bottom lids 52 and 48.)

When liquid is removed from a canister 22, any liquid in the failed fuel containers 44 can drain out through four screened passages 104 in bottom lid 48. However, the screening in passages 104 is fine enough, that any escaped fissionable material from a failed fuel rod is prevented from passing through screened passages 104. Additionally, four vertical rectangular projections 106 along each edge of lid 48, shown in FIG. 2C, on the lower surface of bottom lid 48 ensure that a minimum spacing is maintained between screened passages 104 and the upper surface of bottom lid 28 for canister 22. Alternatively, a single square vertical projection may be used in the center on the lower surface of lid 48. Thus, sufficient spacing is maintained so that liquid in failed fuel container 44 can easily drain out through passages 104.

Further, screened passages 104 in top lid 52 permit air, or other gas, to enter the interior of failed fuel container 44, as liquid in failed fuel container 44 is draining out, thus facilitating the draining of liquid from a failed fuel container. As previously noted the clearance between each failed fuel container 44 and shield plug 68 is such to prevent the removal of top lids 52 from each failed fuel container when shield plug 68 is in place. Nonetheless, the surface of each top lid 52 where screened passages 104 are formed, are recessed below a lip 54, as seen in FIGS. 2A and 2B. The foregoing arrangement, thus ensures a sufficient space between screened passages 104 of each top lid 52 and the lower surface of shield plug 68, so that air or other gas can enter the interior of each failed fuel container 44, as liquid drains out. Moreover, the screening in passages 104 of the lid 52, ensure that fissionable material cannot escape from container 44, if the container is oriented in a position such that the upper surface of the top lid 52 is not horizontal, or at an elevation less than that of bottom lid 48.

Transportation and Storage of Undamaged Fuel Rod Assemblies

Figure 3:
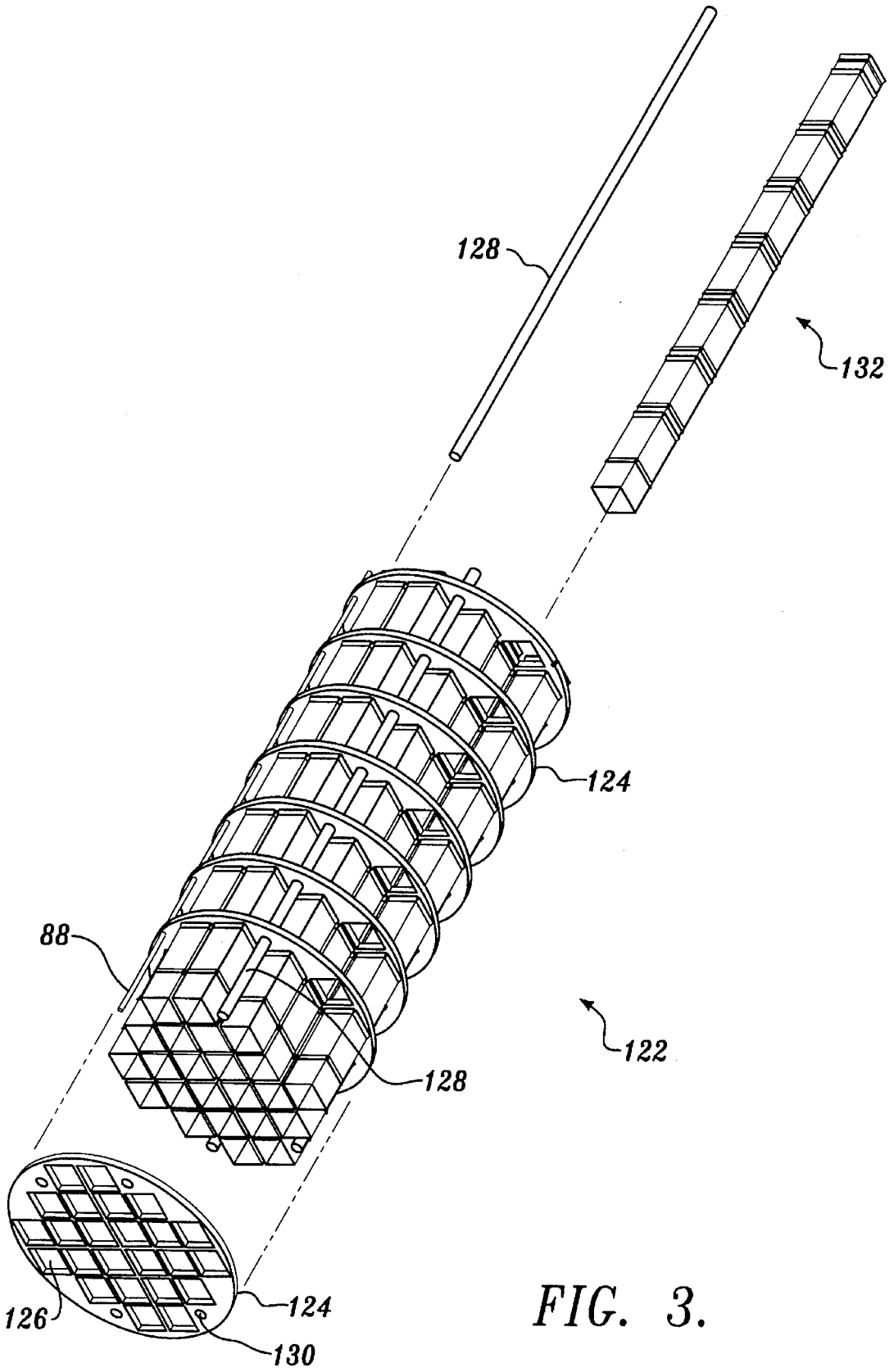
FIG. 3 is a partially exploded isometric view of another aspect of the basket formed in accordance with the present invention.

While basket assembly 24 is preferably for failed fuel rod assemblies, the basket assembly 122 (indicated generally by reference numeral 122), shown in FIG. 3, is designed for the transportation and storage of undamaged fuel rod assemblies. Basket assembly 122 is inserted into canister 22, shown in FIGS. 1, 9A, and 9B, in the same manner that basket assembly 24 of FIGS. 1 and 1A is inserted. Moreover, the manner of sealing the basket assembly 122 into canister 22, is the same as that described with respect to basket assembly 24.

Figure 7:
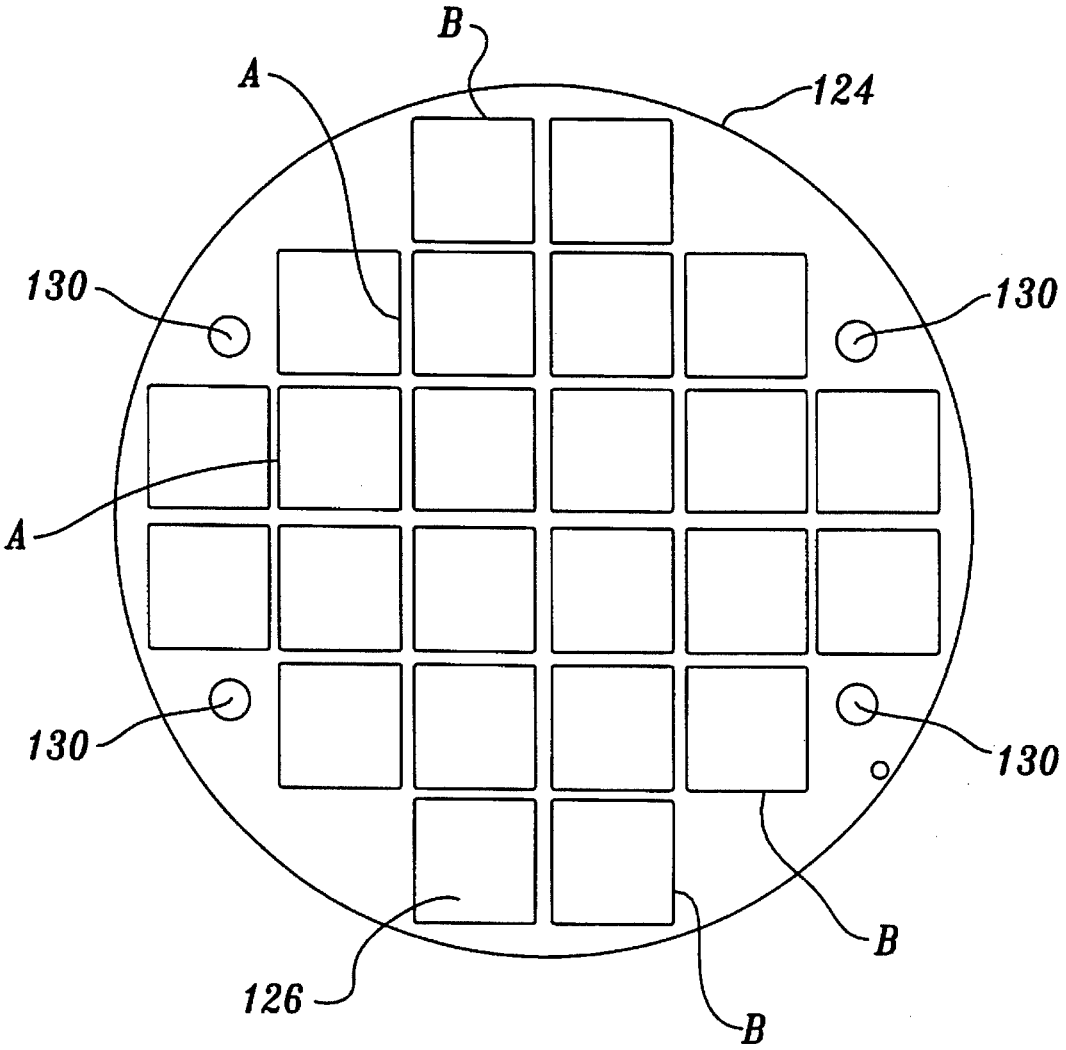
FIG. 7 is a plan view of an apertured disk for the basket shown in FIG. 3.

Basket assembly 122 includes a plurality of generally circular plates 124 having a plurality of generally square-shaped apertures 126 formed therethrough. A top view of a single plate 124 is shown in FIG. 7. Plates 124 are maintained in a spaced-apart axial alignment relative to one another by four rods 128 that pass through each plate. Each rod 128 passes through one of the four holes 130 formed in each plate 124. Rods 128 are welded to each plate 124, to prevent movement of the plates 124 relative to rods 128. The plates 124 are preferably made of a high strength carbon steel, and interconnecting rods 128 are preferably made of stainless steel. The holes 130 preferably include an insert, to mitigate complications caused by welding a stainless steel to a high strength carbon steel.

Each plate 124 includes a substantially identical arrangement of square apertures 126. Thus, when plates 124 are axially aligned relative to one another by rods 128, apertures 126 are aligned into a plurality of rows. Inserted into each row is a guide sleeve assembly 132, indicated generally by reference numeral 132 in FIG. 3. The top and bottom ends of each rod 128 extend beyond the top and bottom ends of each guide sleeve assembly 132. Thus, when basket assembly 122 is inserted into a shell 26, the bottom ends of rods 128 contact the upper surface of bottom lid 28, maintaining a space between the bottom ends of guide sleeve assemblies 132 and bottom lid 28. Additionally, when shield plug 68 is placed on top of basket assembly 122 while in shell 26, the top ends of the rods 128, and ring 66, support shield plug 68 above the top ends of the guide sleeve assemblies 132.

Figures 8A, 8B:
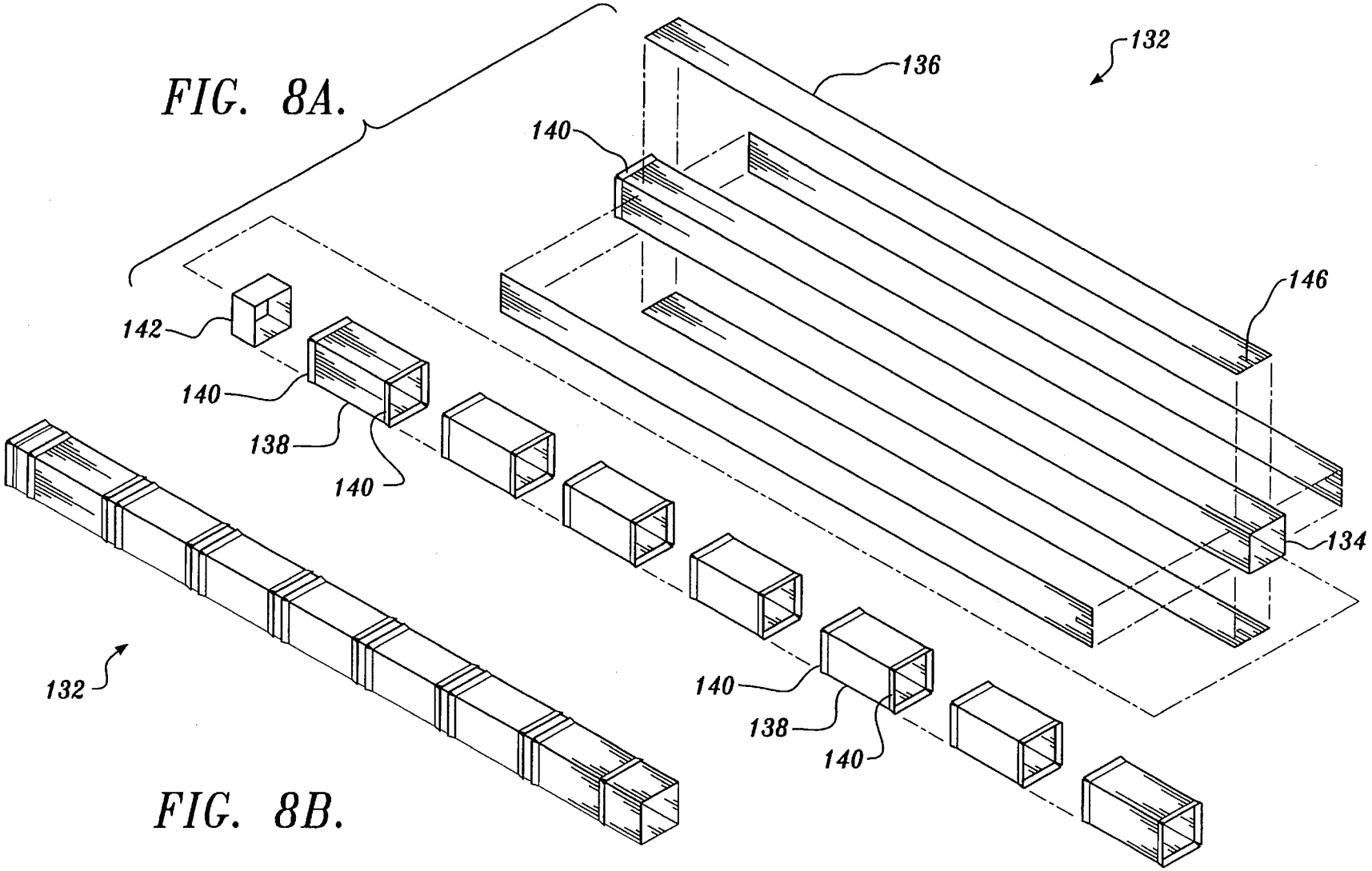
FIG. 8A is a partially exploded isometric view of part of a jacket and neutron absorbing layers formed in accordance with the present invention.
FIG. 8B is an isometric view of part of the assembled jacket and neutron absorbing layers of FIG. 3.

An enlarged view of a part of guide sleeve assembly 132 is shown in FIG. 8A. An assembled view of the assembly of FIG. 8A is shown in FIG. 8B. Each guide sleeve assembly 132 includes an elongated, generally square-shaped inner guide sleeve 134, shown in FIG. 8A. Inner guide sleeve 134 is preferably made of stainless steel, and is inserted into each row of axially aligned square-shaped apertures 126, thus passing through each plate 124. The top end of each guide sleeve 134 includes a flare 140, to facilitate the insertion of a fuel rod assembly, described below.

Disposed adjacent each exterior face of inner guide sleeve 134 is a rectangular-sheet 136 of a neutron absorbing material or of aluminum, depending on the location of the rectangular sheet 136. If a rectangular sheet 136 is in a location A, as shown in FIG. 7, that directly faces another row of axially aligned apertures 126, the rectangular sheet is made of a neutron absorbing material. However, if rectangular sheet 136 does not directly face another row of axially aligned apertures 126, e.g., position B in FIG. 7, the rectangular sheet need not be made of neutron poisoning material, but may be made of aluminum, steel, or other structural support material.

If the rectangular sheet is made of a neutron poisoning material, preferably the material is borated aluminum. However, any neutron poisoning material may be used such as cadmium, borated stainless steel, borated ceramic materials, etc. Four such rectangular sheets 136 are inserted into each row of axially aligned apertures 126, so that one rectangular sheet 136 is disposed between each exterior face of each inner guide sleeve 134, and each plate 124.

Surrounding rectangular sheets 136 and inner guide sleeves 134, are a series of shorter outer guide sleeves 138. An outer guide sleeve 138 surrounds each portion of an inner guide sleeve 134, and the corresponding rectangular sheets 136, that is exposed between an adjacent pair of plates 124. Thus, outer guide sleeves 138 may be of different lengths to account for different spacing between an adjacent pair of plates 124. The ends of each outer guide sleeve 138 include a flare 140 to bear against the surface of each plate 124, best seen in FIG. 4A.

The ends of each inner guide sleeve 134 that projects beyond the top and bottom plates 124, are not surrounded by an outer guide sleeve 138. The top projecting end of each inner guide sleeve is surrounded by a finishing cap 142, that is preferably made of steel. The bottom end of each inner guide sleeve is as shown in FIG. 4A.

Figure 4A:
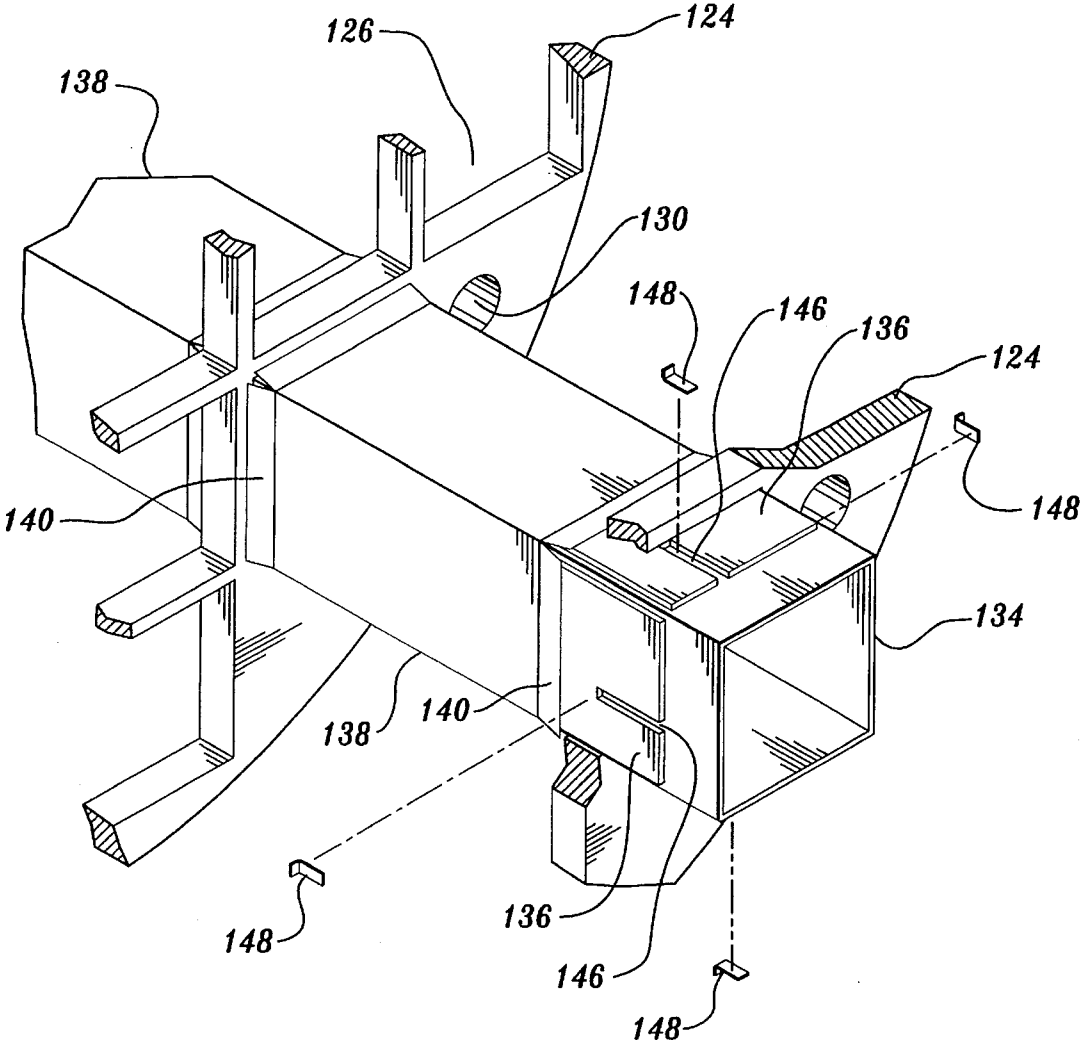
FIG. 4A is a partially exploded isometric view of a portion of the basket shown in FIG. 3.

Best seen in FIG. 4A is the that the bottom end of each rectangular sheet 136 includes a rectangular notch 146, for receiving an L-shaped bracket 148. Each bracket 148 is fastened to the inner guide sleeve 134 and to bottom plate 124, which prevents vertical movement of inner guide sleeves 134 and rectangular sheets 136 relative to the plates 124. The brackets 148 may be fastened to the inner guide sleeves 134 and the bottom plate 124 by welding, screws, or any other known manner. As previously noted, items welded together are preferably of the same of material to avoid complications with items having different material properties. Since the inner guide sleeves 134 are preferably made of stainless steel, the brackets 148 may be made of stainless steel and welded to the inner guide sleeves, and screwed to the bottom plate 124, which is preferably made of a high strength carbon steel.

As noted previously, basket assembly 122 is inserted into a canister 22, in the same manner as the basket assembly 24 for failed fuel rod assemblies. Once basket assembly 122 for undamaged fuel rod assemblies is inserted into canister 22, undamaged fuel rod assemblies may be inserted into each guide sleeve assembly 132, and canister 22 sealed and siphoned, as described earlier.

The multi-layer construction of the guide sleeve assemblies 132, including a neutron poisoning layer (the rectangular sheets 136) in "A" positions, as previously described, provide an additional safety factor against the danger of neutron multiplication to a critical level. Thus, basket assembly 122 in combination with canister 22, may be inserted into a cask, described before, and the cask/canister combination may be used to transport the fuel rod assemblies across areas accessible to the public.

Fuel Only Rod Assemblies vs. Fuel Rod Assemblies Including Control Elements

As is well know in the art, fuel rod assemblies that include only fuel, are shorter in length than fuel rod assemblies that include control elements. In accordance with the present invention, canister 22 and basket assembly 122 may be used with either type of fuel rod assembly, without any change in the outside dimensions of canister 22.

The foregoing is accomplished by the use of the two different shield plugs 76 and 68, shown in FIGS. 5A and 6A, respectively. When canister 22 and basket assembly 122 is to be used with the shorter fuel rod assemblies that include only fuel, all-steel shield plug 76 is used. All-steel shield plug 76 is thicker than shield plug 68 that also includes a lead layer. Thus, thicker shield plug 76 takes up more vertical space in the canister 22, and accounts for the shorter length of the fuel only fuel rod assemblies.

Thicker shield plug 76 is preferably used with thicker bottom lid 28, shown in FIG. 5B, that includes only steel layers 116, 118 and 120, as previously described. The thick bottom lid 28, comprising all steel layers, also takes up more vertical space in canister 22, relative to the thinner bottom lid 28, shown in FIG. 6B, that includes a lead layer 110.

When basket assembly 122 is to be used with the longer fuel rod assemblies including control elements, thinner shield plug 68 is used, that includes a lead layer 70. Lead has a greater shielding capability, and thus provides the same amount of shielding as the non-lead plug, although the thinner shield plug 68, is significantly thinner relative to the all-steel shield plug 76. Thinner bottom lid 28, incorporating a lead layer 110 is preferably used in combination with thinner shield plug 68.

Rather than using shield plug 76 of greater thickness, spacers could be inserted into each guide sleeve assembly 132, that would account for shorter fuel rod assemblies. Further, such spacers, could be used to mix shorter fuel rod assemblies with longer fuel rod assemblies in the same basket assembly. Finally, such spacers could also be used with basket assembly 24 for failed fuel rod assemblies of different lengths.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A container for receiving a structurally damaged nuclear fuel assembly that includes fissionable material, from within a fuel pool, and for subsequent storage and transportation of the nuclear fuel assembly, comprising:

(a) an elongated receptacle, forming an enclosure, having an open end, the open end for receiving a structurally damaged nuclear fuel assembly;

(b) a cover, adapted to mate with the open end of the receptacle, thereby substantially closing the open end of the receptacle; and (c) a drainage passage defined in the container, forming a path of fluid communication from the interior of the receptacle to the exterior of the receptacle, wherein the drainage passage includes a filter to prevent the passage of fissionable material therethrough, the filter being adapted to allow liquid to flow through it while filtering particles from the liquid flow.

2. The container of claim 1, further comprising a projection on the exterior of the container for receiving fuel handling tools used to handle the container.

3. The container of claim 2, wherein the projection is located on the cover so that fuel handling tools can be used to handle the cover alone, and the entire container when the cover is in place on the receptacle.

4. The container of claim 1, the container further comprising a first longitudinal end and a second longitudinal end, wherein the drainage passage is defined in the first longitudinal end of the container so that when the container is oriented with its longitudinal axis substantially vertical and the first longitudinal end is lower in elevation than the second longitudinal end, liquid within the container will drain out.

5. A container for receiving a structurally damaged nuclear fuel assembly that includes fissionable material, from within a fuel pool, and for subsequent storage and transportation of the nuclear fuel assembly, comprising:

(a) an elongated receptacle, forming an enclosure, having an open end, the open end for receiving a structurally damaged nuclear fuel assembly;

(b) a cover, adapted to mate with the open end of the receptacle, thereby substantially closing the open end of the receptacle; and (c) a drainage passage defined in the container, forming a path of fluid communication from the interior of the receptacle to the exterior of the receptacle, wherein the drainage passage is formed by at least one hole defined in the container, having a fine mesh screen covering the hole, the fine mesh screen acting as a restrictor to prevent the passage of fissionable material therethrough.

6. A canister for receiving structurally damaged nuclear fuel assemblies, including fissionable material, from within a fuel pool, and for subsequent storage and transportation of the nuclear fuel assemblies, comprising:

(a) a basket assembly, including:

(i) a plurality of apertured plates; and (ii) structural members interconnecting the apertured plates, maintaining the plates in a spaced apart relationship with the apertures in each plate axially aligned into a plurality of rows;

(b) an exterior shell, forming an enclosure open at one end, the exterior shell receiving and surrounding the basket assembly, the basket assembly being oriented within the shell, so that the longitudinal axis of each row is substantially parallel to the longitudinal axis of the shell;

(c) a plurality of containers, each for containing a damaged nuclear fuel assembly, a single container inserted into each row of axially aligned apertures, each container including:

(i) an elongated receptacle, forming an enclosure, having an open end, the open end for receiving a structurally damaged nuclear fuel assembly;

(ii) a cover, adapted to mate with the open end of the receptacle thereby substantially closing the open end of the receptacle;

(iii) a drainage passage defined in the container, forming a path of fluid communication from the interior of the receptacle to the exterior of the receptacle, wherein the drainage passage includes a restrictor to prevent the passage of fissionable material therethrough; and (d) a lid, adapted to mate with the open end of the shell and close the open end of the shell.

7. The canister of claim 6, further comprising a projection on the exterior of each container for receiving fuel handling tools to remove and insert the containers in the canister.

8. The canister of claim 7, wherein the projection is located on the cover so that fuel handling tools can be used to handle the cover alone, and the entire container when the cover is in place on the receptacle.

9. The canister of claim 6, wherein the drainage passage is formed by at least one opening defined in each container, having a fine mesh screen covering the opening.

10. The canister of claim 6, each container further including a closed end opposite the open end of each container, the closed end and the open end generally aligned along a central axis that is generally coincident with the longitudinal axis of a row in which each container is inserted, the open end of each container being nearer the open end of the canister when each container is inserted in a row, wherein a first drainage passage is defined in the closed end of each container so that when each container is inserted in a row, and the canister is oriented so that the longitudinal axis of each container is generally vertical and the closed end is lower in elevation than the open end, substantially any liquid within each container will drain out.

11. The canister of claim 10, each container having a second drainage passage defined in the cover.

12. The canister of claim 6, wherein each container is removable from each row of axially aligned apertures.

13. A canister for receiving structurally damaged nuclear fuel assemblies, the canister comprising an exterior shell forming an enclosure and having a plurality of containers inserted therein, each container being for receiving a structurally damaged nuclear fuel assembly, wherein each container includes:

(a) an elongated receptacle, forming an enclosure, having an open end, the open end for receiving a structurally damaged nuclear fuel assembly;

(b) a cover, adapted to mate with the open end of the receptacle, thereby substantially closing the open end of the receptacle; and (c) a drainage passage defined in the container, forming a path of fluid communication from the interior of the receptacle to the exterior of the receptacle, wherein the drainage passage includes a restrictor to prevent the passage of fissionable material therethrough.

14. The canister of claim 13, further comprising a projection on the exterior of each container for receiving fuel handling tools used to handle each container.

15. The container of claim 14, wherein the projection is located on the cover of each container for permitting fuel handling tools used to handle the cover alone of each container and an entire container when a cover is in place on the container.

16. The container of claim 13, wherein the drainage passage is formed by a least one hole defined in the container, having a screen covering the hole.

* * * * *